US009975218B2

(12) United States Patent
Maennel et al.

(10) Patent No.: US 9,975,218 B2
(45) Date of Patent: May 22, 2018

(54) GRINDING TOOL COMPRISING FORM PROFILE FOR AN OSCILLATING GRINDING DEVICE

(71) Applicant: C. & E. Fein GmbH, Schwaebisch Gmuend-Bargau (DE)

(72) Inventors: Markus Maennel, Alfdorf-Pfahlbronn (DE); Horst Fahrner, Stuttgart (DE)

(73) Assignee: C. & E. Fein GmbH, Schwaebisch Gmuend-Bargau (DE)

( * ) Notice: Subject to any disclaimer, the term of this patent is extended or adjusted under 35 U.S.C. 154(b) by 125 days.

(21) Appl. No.: 15/223,304

(22) Filed: Jul. 29, 2016

(65) Prior Publication Data

US 2017/0028529 A1 Feb. 2, 2017

(30) Foreign Application Priority Data

Jul. 30, 2015 (DE) ..... 10 2015 112 510

(51) Int. Cl.
*B24D 9/00* (2006.01)
*B24B 23/04* (2006.01)

(52) U.S. Cl.
CPC ..... *B24D 9/00* (2013.01); *B24B 23/04* (2013.01)

(58) Field of Classification Search
CPC ..... B24D 9/00; B24D 15/023; B24D 15/04; B24B 23/04; B23D 67/00; B23D 67/12
USPC ..... 451/514, 358, 359
See application file for complete search history.

(56) References Cited

U.S. PATENT DOCUMENTS

| | | | | |
|---|---|---|---|---|
| 734,954 | A * | 7/1903 | Reissman | B24D 15/023 15/231 |
| 2,189,307 | A * | 2/1940 | Bierma | B24D 15/023 15/231 |
| 2,189,980 | A * | 2/1940 | Forsblade | B24D 15/023 451/503 |
| 2,547,837 | A * | 4/1951 | Robbins | B24D 15/023 451/519 |
| 5,295,278 | A * | 3/1994 | Condon | A46B 5/0012 15/104.04 |
| 5,337,523 | A | 8/1994 | Walsh | |
| 5,470,272 | A | 11/1995 | Kikuchi et al. | |
| 8,011,998 | B2 * | 9/2011 | Lamarche | B24D 15/023 451/456 |

(Continued)

FOREIGN PATENT DOCUMENTS

| | | | |
|---|---|---|---|
| DE | 19503078 | A1 | 8/1995 |
| DE | 102010029792 | A1 | 12/2011 |

(Continued)

*Primary Examiner* — George Nguyen
(74) *Attorney, Agent, or Firm* — Muncy, Geissler, Olds & Lowe, P.C.

(57) ABSTRACT

A grinding tool for a grinding device with an oscillatory drive, in particular a rotary oscillatory drive is disclosed, the drive shaft of which can be driven about its longitudinal axis, wherein the grinding tool includes a holder having a support for securing to the drive shaft of the oscillatory drive, and whereon a form profile with a grinding mechanism is provided, wherein the holder includes a profile support for releasable securement of the form profile, and wherein the profile support includes a clamping region, into which the form profile can be inserted with a holding section and can be fixed thereto, and which can be elastically enlarged for releasing the form profile.

20 Claims, 3 Drawing Sheets

(56) References Cited

U.S. PATENT DOCUMENTS

| | | | | |
|---|---|---|---|---|
| 2002/0090902 | A1* | 7/2002 | Draper | B24D 15/023 451/552 |
| 2004/0152405 | A1* | 8/2004 | Stephan | B24D 15/023 451/507 |
| 2006/0030249 | A1 | 2/2006 | Schumacher | |
| 2007/0087673 | A1* | 4/2007 | Cybulski | B24D 15/023 451/514 |

FOREIGN PATENT DOCUMENTS

| | | | |
|---|---|---|---|
| DE | 1020123105306 | A1 | 11/2014 |
| WO | 2004076125 | A1 | 9/2004 |

* cited by examiner

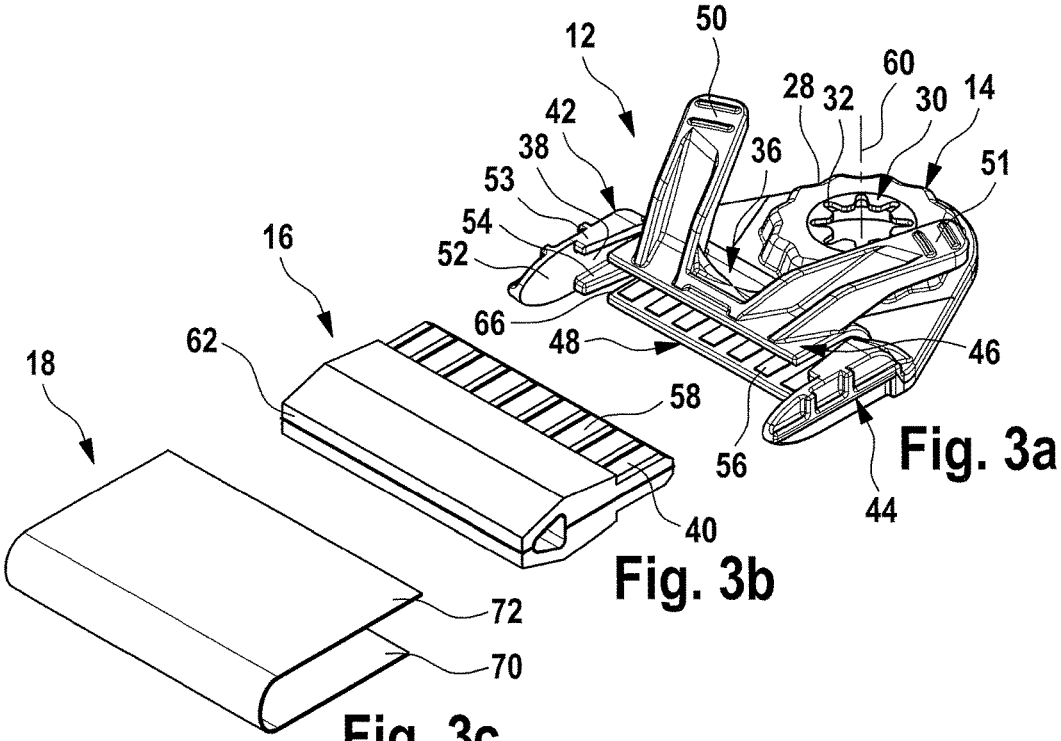
Fig. 3a
Fig. 3b
Fig. 3c
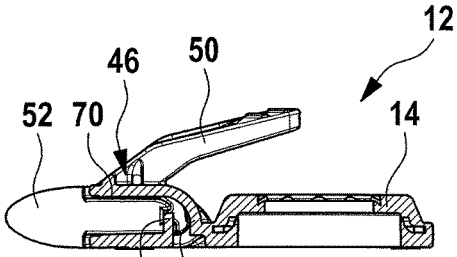
Fig. 5
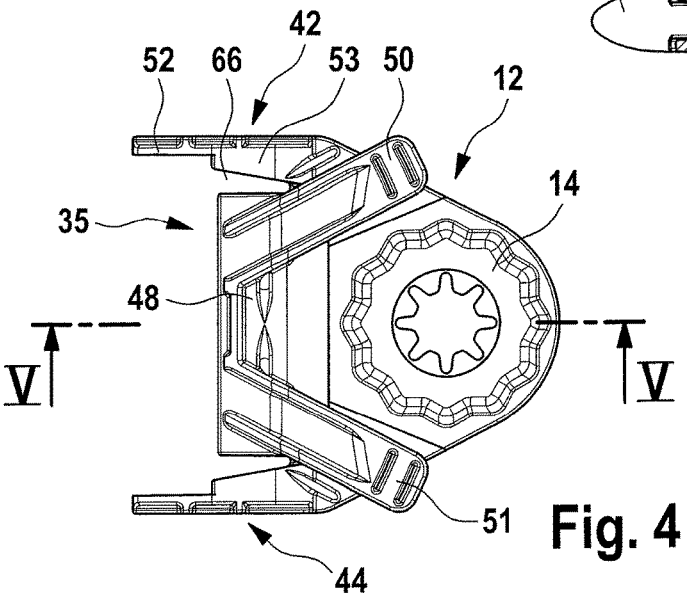
Fig. 4

GRINDING TOOL COMPRISING FORM PROFILE FOR AN OSCILLATING GRINDING DEVICE

CROSS REFERENCES TO RELATED APPLICATIONS

This application claims priority from German patent application 10 2015 112 510.2, filed on Jul. 30, 2015. The entire content of this priority application is incorporated herein by reference.

BACKGROUND OF THE INVENTION

The invention relates to a grinding tool for a grinding device comprising an oscillatory drive, in particular a rotary oscillatory drive the drive shaft of which can be driven oscillatingly about its longitudinal axis, wherein the grinding tool comprises a holder comprising a support for securing to the drive shaft of the oscillatory drive, and whereon a form profile including a grinding means is received.

Such a grinding tool is known from WO 2004/076125 A1.

Such a grinding tool allows a grinding along longitudinal edges, in particular of profiles etc., even in view of the fact that for driving an oscillatory drive is used the rotary shaft of which is driven oscillatingly. By using an elastic grinding pad it is ensured that strong vibrations of the grinding tool are avoided despite of the grinding surface being straight at least in one direction. A grinding means configured as a grinding paper can be secured to the grinding pad by means of a suitable clamping device.

Detrimental is the relatively inconvenient clamping of the grinding paper onto the grinding pad. In addition the grinding tool consists of several individual part which must be put together.

SUMMARY OF THE INVENTION

In view of this it is a first object to disclose an improved grinding tool for a grinding device with a oscillatory drive.

It is a second object of the invention to disclose a grinding tool for a grinding device with a oscillatory drive that can be attached in a very simple way.

It is a third object of the invention to disclose a grinding tool for a grinding device with a oscillatory drive including a holder whereon a grinding paper can be attached in a very simple way.

It is a forth object of the invention to disclose a grinding tool for a grinding device with a oscillatory drive including a holder that allows for an easy handling.

It is a fifth object of the invention to disclose an improved grinding tool that can be produced in a simple and cost-effective manufacture.

According to a first aspect of the invention these and other objects are solved by a grinding tool for a grinding device comprising an oscillatory drive, the drive shaft of which can be oscillatingly driven about its longitudinal axis, said grinding tool comprising:

a holder including a support for securing to said drive spindle of said oscillatory drive;

a form profile including a grinding agent being received on said holder;

a profile support provided on said holder for releasably securing said form profile, said profile support comprising a clamping region being configured for receiving and securing a holding section provided on said form profile when inserting said holding section into said clamping region, said clamping region being further configured for being elastically enlarged to allow a release of said form profile secured within said clamping region.

According to the invention the grinding tool consists only of the holder and the form profile which can be secured to each other. In addition a grinding paper can be secured to the form profile. Alternatively the form profile may be equipped with an abrasive surface.

All in all in this way a particularly simplified design results, a cost-effective manufacture and an exchange possibility for the form profile, in case the letter is worn down or a different form profile is desired. In addition by means of the simplified design and the abandonment of the spring elements consisting of a spring steel a considerable mass reduction results when compared to the prior art. In this way an improved grinding performance can be reached due to the smaller moment of inertia.

According to another aspect of the invention at the clamping region there is attached at least one handle part for elastically enlarging the clamping region.

In this way the clamping region can be simply elastically enlarged by applying pressure onto the at least one handle part to thus allow to release the form profile and the grinding paper from the clamping region in a particularly simple way or to insert into the latter.

According to a further configuration of the invention the clamping region comprises an elastically enlargeable cavity into which the form profile can be inserted with its holding section and can be secured under the action of the internal stress of the clamping region.

In this way the internal stress of the clamping region is used to allow a safe securement of the form profile with its holding section at the clamping region of the holder.

Herein the form profile can be held frictionally engaged with its holding section within the cavity of the holder.

In this way only the internal stress of the holder within its clamping region is used to ensure a frictionally engaged securement of the form profile at the holder.

Alternatively or in addition the form profile may be held positively secured with its holding section within the cavity of the holder, preferably may be click-secured, wherein the positive locking or the click-securement can be released by elastically enlarging the cavity.

In this way a particularly secure fixation of the form profile at the holder is ensured.

According to a further development of the invention the clamping region at both axial ends of the cavity is limited by end sections wherein between the two end sections on both sides side sections extend which are spaced from the end sections.

In this way the side sections can be configured spring-elastically to thereby allow a high internal stress whereby a safe securement of the form profile with its holding section within the profile support is made possible.

According to a further development of the invention the cavity comprises a substantially U-shaped cross-section.

With such a design the internal stress of the clamping region for securing the form profile can be ensured in a particularly simple way.

According to a further design of the invention at a first one of the two side sections at least one gripping part is attached.

Preferably herein at the first side section two gripping parts are attached which extend from the side sections slanted to the outside.

By using one or several gripping parts at the first side section an elastic deformation of the clamping region can be ensured simply by exerting pressure, to allow for an exchanging the form profile.

Herein the first side section starting from the bent section may yield into a plane section whereon the at least one gripping part is attached from the outside.

The plane section herein preferably serves for direct positioning against the form profile. By contrast the bent section facilitates an elastic deformation upon application of a respective tensile or pressure force.

The end sections that limit the cavity at both axial ends according to a preferred development of the invention each comprise an end face, and thereby interrelated side extensions substantially formed perpendicularly thereto which are each spaced from the adjacent first and second side sections by a slot.

Such a design allows to receive and to guide an inserted form profile at the end sections, while by the spacing of the first and second side sections by means of a slot the elasticity of which can be ensured to allow for an elastic enlargement of the surrounded cavity for exchanging the form profile.

According to a further preferred development of the invention at the end sections stops are provided for limiting the insertion depth of the form profile into the cavity.

In this way a precise positioning of the form profile is ensured.

According to a further development of the invention the form profile is coated with a grinding agent at least at a part of its outer surface.

In this way a grinding is made possible directly using the outer surface of the form profile.

According to a further development of the invention the form profile is configured for receiving a grinding paper which can be secured together with the form profile within the cavity of the holder.

In this way after a wear-down of the form profile not the complete form profile must be disposed of. By contrast during grinding the grinding paper is worn which can be easily exchanged.

Herein the grinding paper preferably has dimensions adapted to the outer surface of the form profile so that the grinding paper at least partially wraps around the outer surface of the form profile and is held with both ends between the holding section of the form profile and the side sections of the holder.

In this way a simple securement of the grinding paper is made possible.

According to a further development of the invention the grinding paper in the clamped state is pressed at each of its ends facing the holder into a depression which is formed in the assigned side sections of the holder.

In this way an improved holding force for the grinding paper can be reached.

According to a further development of the invention the form profile consists of an elastically yielding material, such as polyurethane foam for example.

Such a material design facilitates a grinding along longitudinal edges and longitudinal profiles, since vibrations can be partially offset in this way.

According to a further development of the invention the holder is made unitary from a plastic material, preferably as an injection molded part.

This allows for a simple and cost effective manufacture and a particularly favorable design of the clamping region which is elastically enlargeable for releasing the form profile.

According to a further development of the invention at both side sections of the holder on the surface facing the form profile webs are provided to which grooves at the form profile are assigned.

Thereby a positive securement of the form profile is ensured so that during a grinding process a lateral yielding is avoided.

The support of the holder preferably is configured for positive connection with the drive spindle of the oscillatory drive.

To this end suitable embosses of the support or assigned adapters can be provided to ensure a direct mating to an assigned positive fitting support at the drive spindle.

According to a further development of the invention the support of the holder defines a longitudinal axis, wherein the form profile extends at least in one direction of extension straight and perpendicularly to the longitudinal axis of the support.

By such a design a grinding longitudinal profile is made possible.

It is understood that the afore mentioned features and the features of the invention to be explained hereinafter can it only be used in the given combination, but also in different combinations or independently, without departing from the scope of the invention.

BRIEF DESCRIPTION OF THE DRAWINGS

Further features and advantages of the invention can be taken from the subsequent description of preferred embodiments with reference to the drawings. In the drawings show:

FIGS. 3*a*-3*c* an explosive representation of the individual parts of the grinding tool comprising a holder according to FIG. 3*a*, a form profile according to FIG. 3*b* and an assigned grinding paper according to FIG. 3*c;*

FIG. 4 a top view of the holder according to FIG. 3*a;*

FIG. 5 a cross section through the holder according to FIG. 4 along the line V-V;

DESCRIPTION OF PREFERRED EMBODIMENTS

Figure 1:
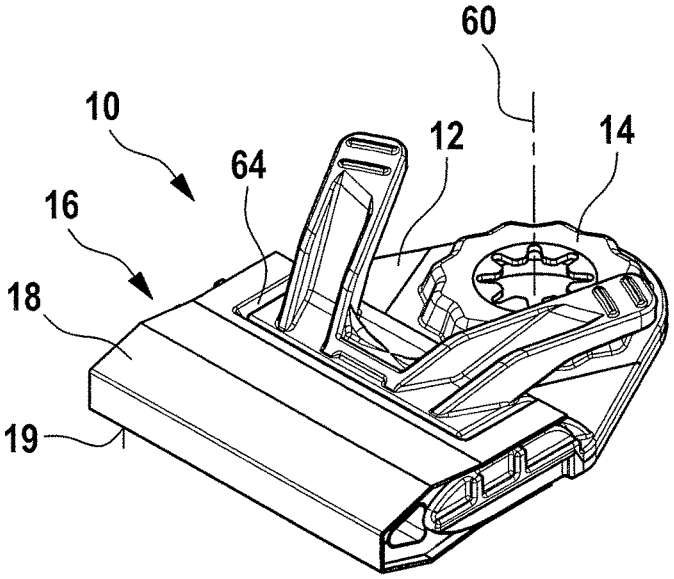
FIG. 1 a perspective view of a grinding tool according to the invention.

A grinding tool according to the invention is shown in FIG. 1 in perspective and designated in total with numeral 10. The grinding tool 10 comprises a holder 14 at which a form profile 16 and a grinding means 18 configured as a grinding paper are supported.

Figure 2:
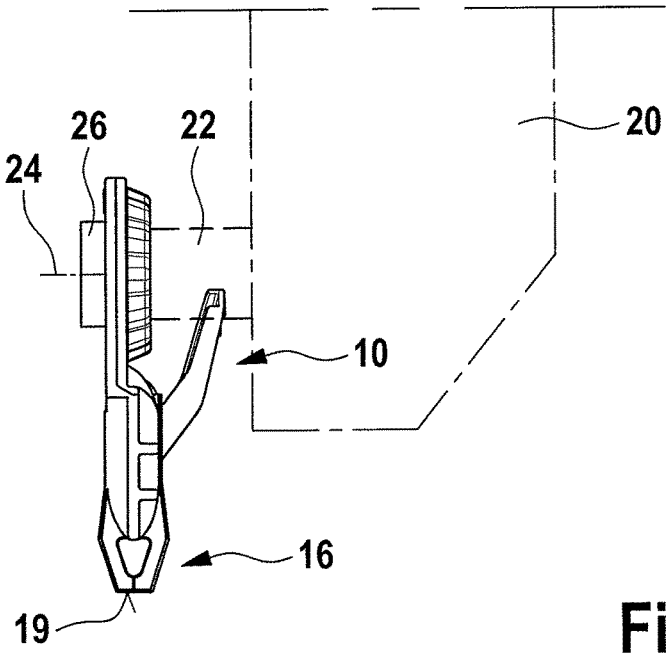
FIG. 2 the grinding tool according to FIG. 1 which is secured to an assigned drive spindle of an oscillatory drive in its application position.

The grinding tool 10 is configured for utilization with a oscillatory drive of known design, such as shown schematically in FIG. 2. The oscillatory drive 20 comprises a drive spindle 22 which can be driven about its longitudinal axis 24 in rotary oscillating fashion at high frequency in the range of about 10.000 to 25.000 oscillations per minute and with a small pivot angle of about ±0.5 to ±5°. The grinding tool 10 is secured positively at the outer end of the drive spindle 22 with a suitable support and is safeguarded by means of a securing element 26.

The grinding tool 10 serves in particular for grinding longitudinal profiles and longitudinal recesses. To this end the form profile 16 and the assigned grinding means 18 are supported exchangeably at the holder 12 as will explained in more detail in the following. The shape of the form profile 16 expediently is adjusted to the longitudinal profile that is to be ground. Thus different form profiles with different cross sections may be provided which are secured exchangeably to the holder 12. In the case shown in FIG. 1 the form profile 16 comprises several flat formed surfaces which are arranged at an angle to each other. Herein a plane designed front face 19 of the form profile 16 extends perpendicularly to the longitudinal axis 24 of the drive shaft 22, and thus also perpendicularly to the longitudinal axis 60 which is defined by the support 14 of the holder 12.

The more detailed design of the grinding tool 10 now will be explained with reference to FIGS. 3 to 8.

From FIGS. 3*a*-3*c* it can be seen that the grinding tool 10 is made up at least of two parts, possibly of three parts. In any case to this end a holder 12 with a support 14 is configured for connection with the drive spindle 22 (FIG. 2). At the holder 12 the form profile 16 together with a suitably shaped grinding means 18 being configured as a grinding paper can be secured. The form profile 16 according to a first design at its surface may be provided with a grinding agent to thus allow a grinding directly with the form profile 16. Alternatively also a separate grinding means 18 configured as a grinding paper may be provided, the shape of which is adapted to the shape of form profile 16 and which can be secured together therewith at the holder 12.

The holder 12 consists of a rigid plastic material and comprises a clamping region 36 having a cavity 38 into which the form profile 16 can be inserted with an assigned holding section 40 and can be secured thereto. To ensure a force transmittance between the drive spindle 22 and the holder 12, within the support 14 a driving disk 30 made of metal, in particular of steel, is molded (cf., FIG. 1, 3, 7, 8) that allows for a positive force transmittance to the drive spindle 22. To this end suitable recesses 32 are provided at the driving disk.

The clamping region 36 comprises two side sections 46, 48 facing each other which are connected in one piece with the holder 12. The axial ends of the cavity 38 are closed by end sections 42, 44, wherein respectively one flat end face and two side extensions 53, 54 facing each other are provided. Between the end sections 43, 44 the side sections 46, 48 are enclosed which each are divided from the end sections 42, 44 by a slot 66. This leads to the consequence that the two side sections 46, 48 facing each other that are only connected at there inner ends with the holder 12 can be enlarged relative to each other.

To this end at the first side section 46 there are provided two gripping parts 50, 51 extending slanted to the outside. In case pressure is exerted onto the gripping parts 50, 51 from the outside, then the first side section 46 can be slightly widened to the outside relative to the second side section 48 to thus allow an insertion of the form profile 16 into the cavity 38 of the holder, or a withdrawal of the form profile 16 with its holding section 40 from the cavity 38.

In addition at the inner surfaces of the first side section 46 and the second side section 48 there may be provided webs 56 extending in insertion direction of the form profile 16, to which respective grooves 58 are assigned at the holding section 40 of the holder 12.

In this way during insertion of the form profile 16 with its holding section 40 into the cavity 38 of the holder 12, a positive support is made possible which impedes a shifting of the form profile 16 in longitudinal direction.

If the form profile 16 shall be inserted with its holding section 40 into the cavity 38 of the holder, only pressure must be exerted onto the two gripping parts 50, 51, whereby the first side section 46 enlarges to the outside relatively to the second side section 48.

Now the form profile 16 can be slid with its holding section 40 into the cavity 38 and is guided herein by the grooves 58 and the assigned webs 56. If the form profile 16 is slid sufficiently deep into the cavity 38 or abuts therein, then the gripping parts 50, 51 are released, whereby the form profile 16 is safely secured within the clamping region 36 under the action of the internal stress of the clamping region 36.

If a separate grinding means 18 configured as a grinding paper according to FIG. 3*c* is used, then this comprises a flat contour according to FIG. 3*c* which preferably at both side faces facing each other is pressed into a recess 64 (FIG. 1) which is shaped so that the two side sections 46, 48 of the holder 12 can directly interfere to thus ensure a safe securement of the grinding means 18. The grinding means to this end is placed onto the form profile 16 and is inserted together therewith into the widened clamping region 36 of the cavity 38, and thus is secured together with the form profile 16. Herein the shape of the grinding means 18 adjusts to the outer shape of the form profile 16.

The form profile 16 preferably consists of a yielding plastic foam, such as a polyurethane foam, to allow for a suitable yielding of the form profile during grinding.

Figure 6:
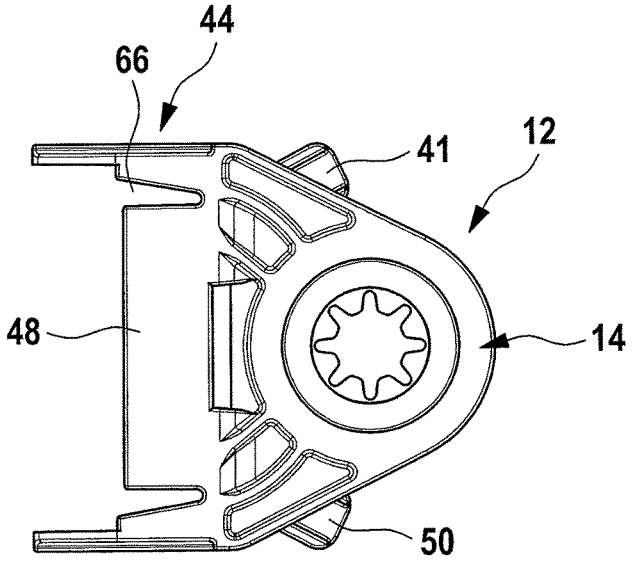
FIG. 6 a plan view of the holder according to FIG. 4 seen from the bottom.
Figure 7:
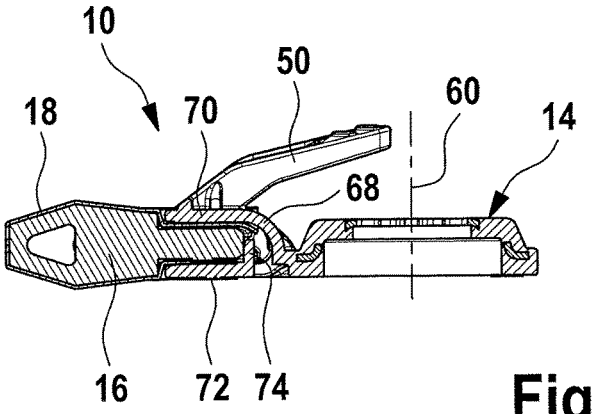
FIG. 7 a longitudinal section through the grinding tool according to FIG. 1.
Figure 8:
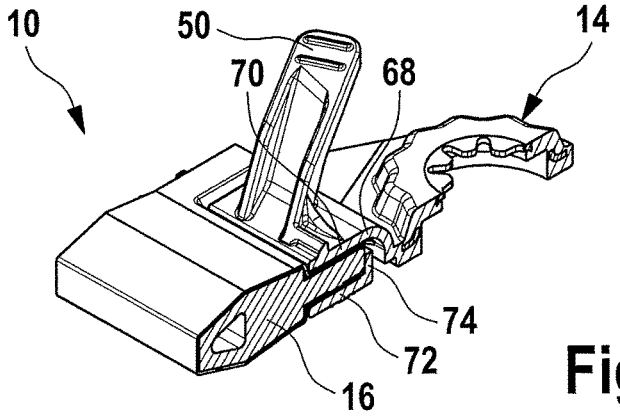
FIG. 8 a perspective cross section of the grinding tool according to FIG. 7.

While FIG. 6 shows the holder 12 from the bottom without the adaptor 30, from FIG. 7 a longitudinal section and from FIG. 8 a perspective longitudinal section through the grinding tool 10 can be seen.

As can be seen in particular from FIGS. 5 to 8, the first side section 46 is received at the body of the holder 14 with a bent section 68 which subsequently yields into a flat section 70. The opposite second side section 48 comprises a flat section 72 facing the first flat section 70 and at its inner end has a stop 74 formed perpendicularly therein serving as a stop when inserting the form profile 16.

The holder 12 is prepared as an injection molded part from a rigid plastic material (e.g. PVC). Thus a cost effective manufacture at high quantities and the same time an elasticity of the clamping region 36 is made possible.

What is claimed is:

1. A grinding tool for a grinding device comprising an oscillatory drive, the drive shaft of which can be oscillatingly driven about its longitudinal axis, said grinding tool comprising:

a holder including a support for securing to said drive spindle of said oscillatory drive;

a form profile including a grinding agent being received on said holder;

a profile support provided on said holder for releaseably securing said form profile, said profile support comprising a clamping region being configured for receiving and securing a holding section provided on said form profile when inserting said holding section into said clamping region, said clamping region being further configured for being elastically enlarged to allow a release of said form profile secured within said clamping region;

at least one gripping part being attached to said clamping region to allow an elastic enlargement of said clamping region; and an elastically enlargeable cavity provided within said clamping region into which said form profile can be inserted with its holding section and can be secured under action of an internal stress of said clamping region.

2. The grinding device of claim 1, wherein said form profile is secured frictionally engaged with its holding section within said cavity of said holder.

3. The grinding device of claim 1, wherein said form profile is held positively with its holding section within said cavity of said holder, wherein said positive engagement can be released by an elastic enlargement of said cavity.

4. The grinding device of claim 1, wherein said clamping region is limited at both axial ends of said cavity by end sections, wherein between said end sections on both sides respective side sections extend which are spaced from said end sections.

5. The grinding device of claim 1, wherein said cavity comprises a substantially U-shaped cross-section.

6. The grinding device of claim 4, wherein at least one gripping part is attached to a first one of said side sections.

7. The grinding device of claim 6, wherein two gripping parts are attached at said first side section and extend from said side section slanted to the outside.

8. The grinding device of claim 6, wherein said first side section starting from a bent section yields into a plane section onto which said at least one gripping part is attached from the outside.

9. The grinding device of claim 4, wherein said end sections each comprise an end face and lateral attachments substantially extending perpendicularly thereto, each being spaced from said adjacent first and second side sections by a slot.

10. The grinding device of claim 9, wherein at both end sections there is provided at least one stop for limiting an insertion depth of said form profile into said cavity.

11. The grinding device of claim 1, wherein said form profile is coated at least at a part of its outer surface by means of a grinding agent.

12. The grinding device of claim 1, wherein said form profile is configured for receiving a grinding paper which can be secured together with said form profile within said cavity of said holder.

13. The grinding device of claim 4, wherein said grinding paper is mated such to said outer surface of said form profile, so that said grinding paper at least partially wraps around said outer surface of said form profile and is held with both ends between a holding section of said form profile and said side sections of said holder.

14. The grinding device of claim 1, wherein said form profile is made of an elastically yielding material.

15. The grinding device of claim 4, wherein at said side sections of said holder webs are provided at each surface facing said form profile, to which grooves at said form profile are assigned.

16. The grinding device of claim 1, wherein said support defines a longitudinal axis and in that said form profile extends at least in one direction of extension straight and perpendicularly to said longitudinal axis of said support.

17. A grinding tool for a grinding device comprising an oscillatory drive, the drive shaft of which can be oscillatingly driven about its longitudinal axis, said grinding tool comprising:

a holder including a support for securing to said drive spindle of said oscillatory drive;

a form profile including a grinding agent being received on said holder;

a profile support provided on said holder for releaseably securing said form profile, said profile support comprising a clamping region comprising a cavity being configured for receiving and securing a holding section provided on said form profile when inserting said holding section into said clamping region, said clamping region being further configured for being elastically enlarged to allow a release of said form profile secured within said clamping region.

18. The grinding device of claim 1, wherein said support is configured for a positive connection to said drive shaft of said oscillatory drive.

19. The grinding device of claim 1, wherein said support defines a longitudinal axis and in that said form profile extends at least in one direction of extension straight and perpendicularly to said longitudinal axis of said support.

20. A grinding tool for a grinding device comprising an oscillatory drive, the drive shaft of which can be oscillatingly driven about its longitudinal axis, said grinding tool comprising:

a holder including a support for securing to said drive spindle of said oscillatory drive;

a form profile including a grinding agent being received on said holder;

a profile support provided on said holder for releaseably securing said form profile, said profile support comprising a clamping region being configured for receiving and securing a holding section provided on said form profile when inserting said holding section into said clamping region, said clamping region being further configured for being elastically enlarged to allow a release of said form profile secured within said clamping region.

* * * * *